United States Patent [19]

Kyogoku et al.

[11] Patent Number: 5,049,466

[45] Date of Patent: Sep. 17, 1991

[54] PHOTOSENSITIVE MEMBER WITH INTERMEDIATE LAYER OF HIGH POLYMER RESIN

[75] Inventors: Tetsuo Kyogoku; Yuji Shintani, both of Osaka, Japan

[73] Assignee: Minolta Camera Kabushiki Kaisha, Osaka, Japan

[21] Appl. No.: 300,979

[22] Filed: Jan. 24, 1989

[30] Foreign Application Priority Data

Jan. 25, 1988 [JP] Japan ..... 63-14070

[51] Int. Cl.[5] ..... G03G 5/08

[52] U.S. Cl. ..... 430/66; 430/64; 430/67

[58] Field of Search ..... 430/64, 67, 66

[56] References Cited

U.S. PATENT DOCUMENTS 3,650,737 3/1972 Maissel et al. ..... 430/67
3,874,942 4/1975 Negishi et al. ..... 430/67
4,409,309 10/1983 Oka ..... 430/65
4,426,435 1/1984 Oka ..... 430/132
4,444,862 4/1984 Yagi et al. ..... 430/67

FOREIGN PATENT DOCUMENTS 56-74257 6/1981 Japan .
57-30844 2/1982 Japan .

*Primary Examiner*—Charles L. Bowers, Jr.
*Assistant Examiner*—Thorl Chea
*Attorney, Agent, or Firm*—Burns, Doane, Swecker & Mathis

[57] ABSTRACT

The disclosure relates to a photosensitive member comprising an electrically conductive substrate, a photoconductive layer of a ceramic material, an intermediate layer of an organic high polymer formed on the photoconductive layer and having a thickness of about 0.01 to about 1 micron and an overcoat layer of a ceramic material formed on the intermediate layer. The intermediate layer has a volume resistivity smaller than that of the overcoat layer.

9 Claims, 1 Drawing Sheet

PHOTOSENSITIVE MEMBER WITH INTERMEDIATE LAYER OF HIGH POLYMER RESIN

BACKGROUND OF THE INVENTION

1. Field of the Invention

The present invention relates to an electrophotographic photosensitive member for use in an electrophotographic process including charging, exposure and development.

DESCRIPTION OF THE RELATED ART

Conventional photosensitive members include those comprising as disclosed in U.S. Pat. No. 3,874,942 an electrically conductive substrate, a photoconductive layer of a ceramic formed on the conductive substrate and an overcoat layer of a ceramic formed on the photoconductive layer. The term "ceramic" is used herein to mean any of the products of nonmetallic inorganic materials prepared by firing and melting. The photoconductive layer of the disclosed photosensitive member is protected with the overcoat layer and given improved resistance to damage since the photoconductive layer is susceptible to damage.

In the conventional photosensitive member, the photoconductive layer is formed by a photosensitive metal compound, such as selenium compound ($As_2Se_3$ or Se-Te), which has an excellent sensitivity to short wavelengths of 400 to 500 nm and is advantageous to blue ray exposure. Further used for forming the overcoat layer is a ceramic material, such as $Al_2O_3$ or $SiO_2$, having high hardness. When used in copying machines, such a photosensitive member is locally heated to a temperature of nearly 100° C. due to the radiation of heat from the fixing device and the frictional heat evolved by the cleaning blade. The material such as $Al_2O_3$, $SiO_2$ or the like for forming the overcoat layer has a small coefficient of linear expansion which is one fifth that of the selenium compound forming the photoconductive layer. Therefore, repeated rises in temperature during successive copying cycles cause thermal distortion in the overcoat layer, thereby creating the problem of reduced adhesion of the overcoat layer. As a result, the overcoat layer develops a crack or becomes separated, leading to damage to the photoconductive layer.

SUMMARY OF THE INVENTION

The main object of the present invention is to provide a photosensitive member of the type described which is diminished in the thermal distortion due to the difference in the coefficient of linear expansion between the overcoat layer and the photoconductive layer to prevent the impairment of the adhesion of the overcoat layer.

Another object of the invention is to provide a photosensitive member wherein the overcoat layer is prevented from separation and thereby given improved durability.

These and other objects of the invention can be accomplished by providing a photosensitive member comprising an intermediate layer formed of a high polymer resin and interposed between a photosensitive metal compound photoconductive layer and a ceramic overcoat layer.

DESCRIPTION OF THE PREFERRED EMBODIMENTS

Figure 1:
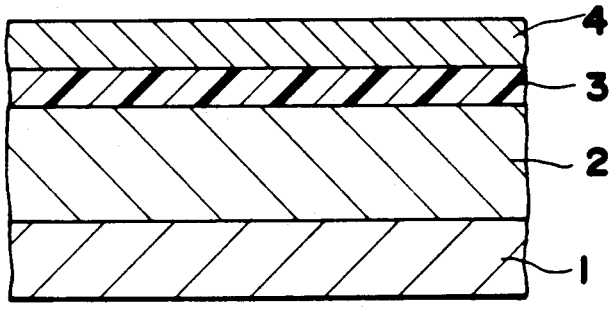
FIG. 1 is an enlarged fragmentary view in section showing a photosensitive member embodying the invention.

Electrophotographic photosensitive members embodying the invention will be described below in detail with reference to the drawing.

First Embodiment

FIG. 1 shows the first of the embodiments which comprises an electrically conductive substrate 1, photoconductive layer 2, intermediate layer 3 and overcoat layer 4.

The conductive substrate 1 serves as the base of the photosensitive member and is in the form of a hollow cylinder of aluminum, 4 mm in wall thickness, 100 mm in outside diameter and 340 mm in length.

The photoconductive layer 2 is formed over the outer peripheral surface of the conductive substrate 1 by depositing $As_2Se_3$ to a thickness of 55 μm by vacuum evaporation. The photoconductive layer 2 is $1.2\text{-}4\times10^{-5}$/° C. in coefficient of linear expansion.

The intermediate layer 3 is formed over the surface of the photoconductive layer 2 and has a thickness of 0.5 μm. The intermediate layer 3 is formed by preparing a coating composition from 100 parts of polyester resin ("V-200," product of Toyobo Co., Ltd.), 50 parts of tin oxide-antimony oxide powder ("T-1," product of Mitsubishi Metal Corporation) and 200 parts of toluene-methyl ethyl ketone mixture by dispersion and dilution, spraying the composition onto the photoconductive layer 2 and spontaneously drying the coating.

The polyester resin, which is thermoplastic, has a modulus of tensile elasticity of about $2.0\text{-}4.2\times10^2$ kg/mm$^2$, whereas that of ceramics, such as $As_2Se_3$ for the photoconductive layer 2 or $Al_2O_3$ of the overcoat layer 4 to be described, is about $0.6\text{-}4.0\times10^4$ kg/mm$^2$, the former value thus being much smaller than the latter. The intermediate layer of small modulus of tensile elasticity, when provided between the overcoat layer and the photoconductive layer, prevents the separation of the overcoat layer. Stated more specifically, a stress occurs in the overcoat layer, for example, owing to the heat of cleaning blade. A stress also occurs in the photoconductive layer to act against this stress. If the shearing stress involved is great, the overcoat layer becomes separated, whereas the presence of the intermediate layer mitigates the stress to prevent the overcoat layer from separation.

Examples of useful high polymer resins for forming the intermediate layer are, besides polyester resin, acrylic, vinyl chloride, urethane, epoxy, alkyd, melamine, phenolic, maleic, polyamide, fluorocarbon, polyimide, silicone and like resins. These resins can be used singly, or at least two of them are usable in combination or as modified to a copolymer or the like. The resin to be used is selected in view of the adhesion to the overcoat layer 4. To improve the adhesion of the resin to the photoconductive layer 2, the resin may have incorporated therein an isocyanate, amine or like curing agent or may be crosslinked by treatment with electron rays, or ultraviolet or like radiation.

The tin oxide-antimony oxide powder added to the intermediate layer 3 serves as an electrically conductive filler for giving an adjusted volume resistivity for precluding the rise in the residual potential on the intermediate layer 3. Other examples of such fillers usable are zinc oxide, titanium oxide, iron powder, copper halide and the like. The volume resistivity is adjustable alternatively by using an organic or inorganic high-molecular-weight compound having a polar group such as hydroxyl, amino, amido or carboxyl group, or a surfactant such as quaternary ammonium salt, phosphoric acid ester or silicone compound. Examples of desirable volume resistivity adjusting conductive fillers are $Al_2O_3$, $ZrO_2$, $Y_2O_3$, $TiO_2$, SiC, $Al_6Si_2O_{13}$ (mullite), spinel and the like. The filler is used in an amount of 1 to 40 wt. %, preferably 5 to 20 wt. %, based on the solids of the composition for forming the layer 3.

To prevent the rise in the residual potential, it is desirable that the intermediate layer 3 be adapted to have a volume resistivity of $10^9$ to $10^{13}$ ohm-cm, for example, by the addition of the above-mentioned filler or a physical deposition process (PVD process). When the volume resistivity decreases to less than $10^9$ ohm-cm, the photosensitive member has difficulty in retaining the surface potential, permitting a disturbance of images to give blurred images. If the resistivity exceeds $10^{13}$ ohm-cm, the potential becomes difficult to decay even when exposed to an optical image, with the result that the background area other than the image area fogs owing to a rise in the residual potential.

It is suitable that the intermediate layer 3 be in the range of 0.01 to 1 μm in thickness. If the thickness is less than 0.01 μm, it is difficult to form a uniform layer for affording improved adhesion, whereas if it is larger than 1 μm, it is difficult to preclude rises in the residual potential. Incidentally when the intermediate layer 3 of the present embodiment was formed with a thickness of 0.5 μm, the layer exhibited a volume resistivity of $2\times10^{11}$ ohm-cm and good adhesion to the photoconductive layer 2.

The intermediate layer 3, which was formed by spraying, may alternatively be formed by other known method such as dipping, blade, spinning, curtain, roll, gravure or extrusion method. The intermediate layer 3 was $6\text{-}8\times10^{-5}/°$ C. in coefficient of linear expansion.

The overcoat layer 4 is formed by coating the surface of the intermediate layer 3 with $Al_2O_3$ to a thickness of 0.8 μm by ion plating. The overcoat layer 4, which has high hardness, gives the photoconductive layer 2 improved resistance to damage. This layer may be formed, for example, by vacuum evaporation, sputtering or plasma CVD.

The overcoat layer 4 formed was $8.0\times10^{-6}/°$ C. in coefficient of linear expansion. Preferably, the overcoat layer 4 is $10^{13}$ to $10^{15}$ ohm-cm in volume resistivity. The overcoat layer 4, when thus made greater than the intermediate layer 3 in volume resistivity, eliminates the likelihood that charges will be trapped in the intermediate layer 3.

When the electrophotographic photosensitive member of the present embodiment thus constructed was used as installed in a copying machine, the intermediate layer 3 mitigated the thermal distortion due to the difference in coefficient of linear expansion between the overcoat layer 4 and the photoconductive layer 2, permitting the overcoat layer 4 to retain satisfactory adhesion. When the photosensitive member was tested for making 300,000 copies, the overcoat layer 4 was free of cracking and separation, and the copy images obtained were all found satisfactory.

The photosensitive member was also checked for electrostatic characteristics during and after the repeated use, but the member remained almost free of the accumulation of residual charges and the rise in the residual potential, giving satisfactory images without any disturbance or blurring even at an ambient temperature of 30° C. and humidity of 85%.

Second Embodiment

The second embodiment differs from the first embodiment only in the intermediate layer and is the same as the first with respect to the conductive substrate, the photoconductive layer and the overcoat layer, which therefore will not be described again. The intermediate layer alone will be described with reference to FIG. 1, with like components designated by like reference numerals.

The intermediate layer 3 has a thickness of 0.2 μm and is formed between the photoconductive layer 2 and the overcoat layer 4. The intermediate layer 3 is prepared from a coating composition comprising 100 parts of thermosetting silicone varnish ("Silicone TOSGUARD 520," product of Tokyo Shibaura Electric Co., Ltd., 21% in non-volatile content) and 200 parts of isopropanol, by applying the composition to the surface of the photoconductive layer 2 by dipping, and drying the coating in an oven at a temperature of 120° C. for 1 hour for curing to form siloxane bonds. The intermediate layer 2 thus formed has a volume resistivity of $3\times10^{12}$ ohm-cm and exhibited good adhesion to the photoconductive layer.

Like the first embodiment, the electrophotographic photosensitive member thus constructed was installed in a copying machine and tested for making 300,000 copies. The overcoat layer 3 was free of cracking and separation, and the copy images obtained were all satisfactory.

The photosensitive member further exhibited satisfactory electrostatic characteristics like the first embodiment.

Although the photoconductive layer 2 of the present embodiment is made of $As_2Se_3$, the material is not limited thereto but can be any photosensitive metal compound. While $Al_2O_3$ is used for the overcoat layer 4, this layer can be made of other inorganic material such as $ZrO_2$, $Ta_2O_5$, $SiO_2$, $Y_2O_3$, $HfO_02$, $CeO_2$, $MgF_2$, $TiO_2$, ZnS, SiC or a mixture of such materials.

The electrophotographic photosensitive member of the present invention comprises an intermediate layer of a soft high polymer resin provided between a ceramic overcoat layer and a photosensitive metal compound photoconductive layer. The thermal distortion that would result from the difference in coefficient of linear expansion between the hard overcoat layer and the hard photoconductive layer is therefore mitigated by the soft intermediate layer, which consequently prevents impairment of the adhesion of the overcoat layer. Thus, the intermediate layer precludes the overcoat layer from cracking or separation, giving improved durability to the photosensitive member.

Although the present invention has been fully described by way of examples with reference to the accompanying drawing, it is to be noted that various changes and modifications will be apparent to those skilled in the art. Therefore, unless otherwise such changes and modifications depart from the scope of the present invention, they should be construed as being included therein.

What is claimed is:

1. A photosensitive member comprising:

an electrically conductive substrate;

a photoconductive layer comprising a photosensitive metal compound;

an intermediate layer formed on the photoconductive layer and comprising an organic high polymer resin, said intermediate layer having a thickness of about 0.01 to about 1 micron; and an overcoat layer formed on the intermediate layer and comprising a ceramic material, said overcoat layer having a volume resistivity greater than that of the intermediate layer.

2. A photosensitive member as claimed in claim 1 wherein said intermediate layer has a modulus of tensile elasticity smaller than those of the photoconductive layer and the overcoat layer.

3. A photosensitive member as claimed in claim 2 wherein the modulus of tensile elasticity of the intermediate layer is about $2.0\times10^2$ to $4.2\times10^2$ kg/mm$^2$.

4. A photosensitive member as claimed in claim 1 wherein the intermediate layer has incorporated therein a conductive filler for adjusting the volume resistivity.

5. A photosensitive member as claimed in claim 4 wherein the conductive filler is incorporated in the intermediate layer in an amount of about 1 to 40 wt. %.

6. A photosensitive member as claimed in claim 1 wherein the intermediate layer has a linear expansion coefficient of $6\times10^{-5}$ to $8\times10^{-5}$/° C.

7. A photosensitive member as claimed in claim 1 wherein said ceramic material is metal oxide.

8. A photosensitive member as claimed in claim 7 wherein said metal oxide is a member selected from the group consisting of $Al_2O_3$, $ZrO_2$ and $SiO_2$.

9. A photosensitive member as claimed in claim 1 wherein said organic high polymer resin is a member selected from the group consisting of polyester resin, acrylic resin and polyamide resin.

* * * * *